US008372259B2

(12) United States Patent
Murakami et al.

(10) Patent No.: US 8,372,259 B2
(45) Date of Patent: Feb. 12, 2013

(54) METHOD OF PREPARING CHROMIUM PLATING BATH AND METHOD OF FORMING PLATING FILM

(75) Inventors: Toru Murakami, Pasir Gudang Johor (MY); Suhaimi Hamid, Pasir Gudang Johor (MY); Ryo Maeda, Pasir Gudang Johor (MY)

(73) Assignee: C. Uyemura & Co., Ltd., Osaka-Shi (JP)

( * ) Notice: Subject to any disclaimer, the term of this patent is extended or adjusted under 35 U.S.C. 154(b) by 461 days.

(21) Appl. No.: 12/620,352

(22) Filed: Nov. 17, 2009

(65) Prior Publication Data

US 2010/0122909 A1 May 20, 2010

(30) Foreign Application Priority Data

Nov. 18, 2008 (JP) ..... 2008-294007

(51) Int. Cl.
*C25D 3/04* (2006.01)
*C25D 3/06* (2006.01)
*C25D 3/10* (2006.01)

(52) U.S. Cl. ..... 205/287; 205/283; 205/289; 205/290

(58) Field of Classification Search ..... 205/283, 205/287, 289, 290
See application file for complete search history.

(56) References Cited

U.S. PATENT DOCUMENTS 3,337,431 A * 8/1967 Kitamura et al. ..... 205/319
3,708,430 A * 1/1973 Kadison et al. ..... 252/186.25
4,615,773 A * 10/1986 Dash et al. ..... 205/99

FOREIGN PATENT DOCUMENTS

JP 46-40761 B 12/1971
JP 51076134 A * 7/1976
JP 52-125427 A 10/1977
JP 59-185794 A 10/1984
JP 59-223143 A 12/1984

OTHER PUBLICATIONS

Seiichiro Eguchi, "Formation of Electro-Deposits of Bright Chromium From Chomic Acid Bath, Containing Saturated Dicarboxylic Acids," Journal of the Metal Finishing Society of Japan, vol. 19, No. 11, pp. 451-456, 1968.

Furuya et al., "Preparation of Amorphous CR and Amorphous CR Binary Alloys," Journal of the Metal Finishing Society of Japan, vol. 32, No. 12, pp. 631-636, 1981.

Eguchi et al., "Bath Composition and Electrolytic Condition for Decorative Chomium Plating From Oxalic Acid Baths," Journal of the Metal Finishing Society of Japan, vol. 33, No. 6, pp. 272-277, 1982.

Eguchi et al. "Bath Voltage and Covering Power of Chomium Plating From Oxalic Acid Bath," Journal of the Metal Finishing Society of Japan, vol. 35, No. 2, pp. 104-108, 1984.

Morikawa et al., "Hardness of Chromium Deposition From Oxalic Acid Baths," Journal of the Metal Finishing Society of Japan, vol. 37, No. 7, pp. 341-345, 1986.

Morikawa et al., "Preparation of CR-C Alloy Plating From CR (III) Sulfate-Carboxylate Baths," The Journal of the Surface Finishing Society of Japan, vol. 42, No. 1, pp. 95-99, 1991.

Morikawa et al., "Amorphous CR-C Alloy Plating From CR (III) Sulfate-Ammonium Osalate Bath," The Journal of the Surface Finishing Society of Japan, vol. 42, No. 1, pp. 100-104, 1991.

Kazuo Watanabe, "Decorative Trivalent Chromium Plating," The Journal of the Surface Finishing Society of Japan, vol. 56, No. 6, pp. 320-324, 2005.

* cited by examiner

*Primary Examiner* — Edna Wong
(74) *Attorney, Agent, or Firm* — Birch, Stewart, Kolasch & Birch, LLP

(57) ABSTRACT

A chromium plating bath containing trivalent chromium ions and hexavalent chromium ions is prepared by a method including the steps of: (A) mixing chromic acid and an organic acid in an aqueous solution containing these acids and reducing chromic acid by the organic acid so as to prepare an aqueous solution not containing hexavalent chromium ions; (B) adding a pH adjustor to the aqueous solution not containing hexavalent chromium ions so as to adjust pH to a value of 1 to 4; and (C) further adding chromic acid to the aqueous solution not containing hexavalent chromium ions and having undergone the pH adjustment so as to prepare an aqueous solution containing trivalent chromium ions and hexavalent chromium ions. The chromium plating bath containing both trivalent chromium ions and hexavalent chromium ions can be prepared while easily and assuredly adjusting the contents (content ratio) of trivalent chromium ions and hexavalent chromium ions to predetermined values (a predetermined value).

6 Claims, No Drawings

METHOD OF PREPARING CHROMIUM PLATING BATH AND METHOD OF FORMING PLATING FILM

CROSS-REFERENCE TO RELATED APPLICATION

This non-provisional application claims priority under 35 U.S.C. §119(a) on Patent Application No. 2008-294007 filed in Japan on Nov. 18, 2008, the entire contents of which are hereby incorporated by *reference*.

TECHNICAL FIELD

The present invention relates to a method of preparing a chromium plating bath and a method of forming a plating film.

BACKGROUND ART

Chromium plating baths which have been known include a chromium plating bath containing both trivalent chromium ions and hexavalent chromium ions. In order to make the most of the characteristics of the chromium plating bath containing both trivalent chromium ions and hexavalent chromium ions, the contents (content ratio) of trivalent chromium ions and hexavalent chromium ions in the bath have to be adjusted to predetermined values (a predetermined value). In general, such a plating bath is prepared by a method in which part of chromic acid is reduced to trivalent chromium ions by an organic acid. In the case of preparing the plating bath by this method, the contents (content ratio) of trivalent chromium ions and hexavalent chromium ions will vary depending on the degree of reduction of the hexavalent chromium ions to the trivalent chromium ions. Particularly, both the reaction of dissolution of chromic acid and the organic acid into water and the reduction reaction are exothermic reactions. Therefore, a rigorous temperature control is required for adjusting the contents (content ratio) of trivalent chromium ions and hexavalent chromium ions to predetermined values (a predetermined value).

Furthermore, the hexavalent chromium ion is highly hazardous and, hence, handling of the ion needs a sufficient control or management. Particularly, for avoiding leakage during transportation, it is desirable to obviate as securely as possible the transportation of the hexavalent chromium ions in the state of solution.

Besides, in the fields of utilizing plating films including a chromium plating film, there is a need for chromium plating films having more excellent characteristics, and there is also a need for simplified working steps from the viewpoint of reservation of natural resources and energy saving.

The following references relate to the present invention.

JP-B 46-40761

JP-A 52-125427

JP-A 59-185794

JP-A 59-223143

Seiichiro EGUCHI, "Formation of Electro-deposits of Bright Chromium from Chromic Acid Bath, containing Saturated Dicarboxylic Acids," Journal of the Metal Finishing Society of Japan, Vol. 19, No. 11, pp. 451-456, 1968

Hisashi FURUYA, Yoshinari MISAKI and Yoshimi TANABE, "Preparation of Amorphous Cr and Amorphous Cr Binary Alloys," Journal of the Metal Finishing Society of Japan, Vol. 32, No. 12, pp. 631-636, 1981

Seiichiro EGUCHI and Tooru YOSHIDA, "Bath Composition and Electrolytic Condition for Decorative Chromium Plating from Oxalic Acid Baths," Journal of the Metal Finishing Society of Japan, Vol. 33, No. 6, pp. 272-277, 1982

Seiichiro EGUCHI, Tsutomu MORIKAWA and Masayuki YOKOI, "Bath Voltage and Covering Power of Chromium Plating from Oxalic Acid Bath," Journal of the Metal Finishing Society of Japan, Vol. 35, No. 2, pp. 104-108, 1984

Tsutomu MORIKAWA and Seiichiro EGUCHI, "Hardness of Chromium Deposition from Oxalic Acid Baths," Journal of the Metal Finishing Society of Japan, Vol. 37, No. 7, pp. 341-345, 1986

Tsutomu MORIKAWA, Masayuki YOKOI, Seiichiro EGUCHI and Yukio FUKUMOTO, "Preparation of Cr—C Alloy Plating from Cr(III) Sulfate-Carboxylate Baths," The Journal of the Surface Finishing Society of Japan, Vol. 42, No. 1, pp. 95-99, 1991

Tsutomu MORIKAWA, Masayuki YOKOI, Seiichiro EGUCHI and Yukio FUKUMOTO, "Amorphous Cr—C Alloy Plating from Cr(III) Sulfate-Ammonium Oxalate Bath," The Journal of the Surface Finishing Society of Japan, Vol. 42, No. 1, pp. 100-104, 1991

Kazuo WATANABE, "Decorative Trivalent Chromium Plating," The Journal of the Surface Finishing Society of Japan, Vol. 56, No. 6, pp. 320-324, 2005

SUMMARY OF INVENTION

The present invention has been made in consideration of the above-mentioned circumstances. Accordingly, it is an object of the present invention to provide a method of preparing a chromium plating bath by which a chromium plating bath containing both trivalent chromium ions and hexavalent chromium ions can be prepared while adjusting easily and assuredly the contents (content ratio) of the trivalent chromium ions and the hexavalent chromium ions to predetermined values (a predetermined value).

It is another object of the present invention to provide a method of forming a plating film by which chromium plating films having more excellent characteristics can be formed and the steps for forming the plating films can be simplified, in the fields of utilizing plating films including a chromium plating film, especially in the formation of plating films including a chromium plating film required to have corrosion resistance and in the formation of chromium plating films by barrel plating.

In order to attain the above objects, the present inventor has made extensive and intensive investigations. As a result of the investigations, the inventor found out that when a chromium plating bath containing trivalent chromium ions and hexavalent chromium ions by the steps of:

(A) mixing chromic acid and an organic acid in an aqueous solution containing these acids and reducing chromic acid by the organic acid so as to prepare an aqueous solution not containing hexavalent chromium ions; (B) adding a pH adjustor to the aqueous solution not containing hexavalent chromium ions so as to adjust pH to a value of 1 to 4; and (C) further adding chromic acid to the aqueous solution not containing hexavalent chromium ions and having undergone the pH adjustment so as to prepare an aqueous solution containing trivalent chromium ions and hexavalent chromium ions, the chromium plating bath can be prepared while adjusting easily and assuredly the contents (content ratio) of the trivalent chromium ions and the hexavalent chromium ions to predetermined values (a predetermined value).

In addition, the present inventor found out that when, in forming a plating film composed of a single layer or a plurality of layers on a substrate, a chromium plating film is formed, as the whole part of the single layer or part or the whole part of the plurality of layers constituting the plating film, by electroplating using as a chromium plating bath a chromium plating bath containing both trivalent chromium ions and hexavalent chromium ions, particularly the chromium plating bath containing both trivalent chromium ions and hexavalent chromium ions that is obtained by the above-mentioned preparation method, a plating film having excellent characteristics can be formed, in the formation of a plating film including a chromium plating film required to have corrosion resistance or in the formation of a chromium plating film by barrel plating, and, further, the steps for forming the plating film can be simplified. Based on the findings, the present invention has been completed.

According to a viewpoint of the present invention, there is provided a method of preparing a chromium plating bath containing trivalent chromium ions and hexavalent chromium ions, including the steps of:

(A) mixing chromic acid and an organic acid in an aqueous solution containing these acids and reducing chromic acid by the organic acid so as to prepare an aqueous solution not containing hexavalent chromium ions;

(B) adding a pH adjustor to the aqueous solution not containing hexavalent chromium ions so as to adjust pH to a value of 1 to 4; and (C) further adding chromic acid to the aqueous solution not containing hexavalent chromium ions and having undergone the pH adjustment so as to prepare an aqueous solution containing trivalent chromium ions and hexavalent chromium ions.

In the step (A) above, preferably, chromic acid in an amount of 60 to 140 g/L in terms of the weight of chromium and 50 to 700 g/L of the organic acid are mixed with each other so that the ratio between the amounts of the acids is $$(\text{organic acid})/(\text{chromic acid})=1.5 \text{ to } 4.0 \text{ (molar ratio)}.$$

In the step (C) above, preferably, chromic acid in an amount of 0.1 to 40 g/L in terms of the weight of chromium is added.

The above-mentioned preparation method, preferably, further includes the step of:

(D) adding one or more selected from the group of a conducting salt, a stabilizer and an anti-pitting agent to the aqueous solution, in one or more selected from the group consisting of a period between the step (A) and the step (B), a period between the step (B) and the step (C), and a period after the step (C).

According to another viewpoint of the present invention, there is provided a method of forming a plating film composed of a single layer or a plurality of layers on a substrate, wherein as the whole part of the single layer or part or the whole part of the plurality of layers constituting the plating film, a first chromium plating film is formed by electroplating using as a first chromium plating bath a chromium plating bath containing both trivalent chromium ions and hexavalent chromium ions, the chromium plating bath being obtained by the above-mentioned preparation method.

According to a further viewpoint of the present invention, there is provided a method of forming a plating film composed of a single layer or a plurality of layers on a substrate, wherein a slurry containing chromium hydroxide or basic chromium carbonate is added to the first chromium plating bath decreased in the amount of trivalent chromium ions through formation of the first chromium plating film according to the just-mentioned plating film forming method, so as to replenish the trivalent chromium ions, pH is adjusted, and the first chromium plating film is formed as the whole part of the single layer or part or the whole part of the plurality of layers constituting the plating film by electroplating using the first chromium plating bath replenished with trivalent chromium ions.

In the above-mentioned plating film forming method, preferably, the plating film is composed of a plurality of layers, and the method includes a step of forming a nickel plating film on the substrate, and a step of forming the first chromium plating film on the nickel plating film by electroplating using the first chromium plating bath.

In the just-mentioned plating film forming method, preferably, a corrosion-preventive plating film for an automotive exterior trim or an anti-salt-damage member is formed.

In the above-mentioned plating film forming method, preferably, the plating film is composed of a plurality of layers, and the method includes a step of forming the first chromium plating film on the substrate by electroplating using the first chromium plating bath, and a step of forming on the first chromium plating film a noble metal plating film composed of one or more selected from the group consisting of gold, platinum, silver, rhodium and their alloys, but the method does not include a step of forming a nickel plating film.

In the just-mentioned plating film forming method, a corrosion-preventive plating film for a member to be put in constant contact with a human body is formed.

In the above-mentioned plating film forming method, preferably, the plating film is composed of a plurality of layers, and the method includes a step of forming the first chromium plating film on the substrate by electroplating using the first chromium plating bath, and a step of forming a second chromium plating film on the first chromium plating film by use of a second chromium plating bath different from the first chromium plating bath.

In the above-mentioned plating film forming method, preferably, the plating film is composed of a plurality of layers, and the method includes a step of forming a second chromium plating film on the substrate by use of a second chromium plating bath different from the first chromium plating bath, and a step of forming the first chromium plating film on the second chromium plating film by electroplating using the first chromium plating bath.

In the just-mentioned plating film forming method, preferably, the second chromium plating bath is a hard chromium plating bath containing hexavalent chromium ions mainly and containing a small amount of trivalent chromium ions, as chromium ions.

The above-mentioned plating film forming method, preferably, includes a step of forming the first chromium plating film on the substrate by electroplating using the first chromium plating bath, a step of forming a nickel plating film on the first chromium plating film, and a step of further forming the first chromium plating film on the nickel plating film by electroplating using the first chromium plating bath.

According to yet another viewpoint of the present invention, there is provided a method of forming chromium plating film by barrel plating, wherein the chromium plating film is formed by electroplating using as a first chromium plating bath a chromium plating bath containing both trivalent chromium ions and hexavalent chromium ions, the chromium plating bath being obtained by the above-mentioned preparation method.

According to the present invention, a chromium plating bath containing trivalent chromium ions and hexavalent chromium ions can be prepared while easily and assuredly adjusting the contents (content ratio) of the trivalent chromium ions and the hexavalent chromium ions to predetermined values (a predetermined value).

Besides, in preparation of the chromium plating bath, an aqueous solution not containing hexavalent chromium ions can once be prepared. Therefore, when the aqueous solution not containing hexavalent chromium ions is prepared and transported and thereafter hexavalent chromium ions are added to the aqueous solution at a destination of transportation, the risk of leakage of the highly hazardous hexavalent chromium ions during transportation of the chromium plating bath can be obviated.

Furthermore, a plating film including the chromium plating film formed by use of a chromium plating bath containing both trivalent chromium ions and hexavalent chromium ions, particularly by use of the chromium plating bath obtained by the chromium plating bath preparation method according to the present invention, ensures that a plating film having excellent characteristics can be formed, in the formation of a plating film including a chromium plating film required to have corrosion resistance or in the formation of a chromium plating film by barrel plating.

DESCRIPTION OF EMBODIMENTS

Now, the present invention will be described further in detail below.

In the present invention, a chromium plating bath contains trivalent chromium ions and hexavalent chromium ions.

In the present invention, the chromium plating bath containing trivalent chromium ions ($Cr^{3+}$) and hexavalent chromium ions ($CrO_4^{2-}$) can be prepared by the steps of:

(A) mixing chromic acid with an organic acid in an aqueous solution containing them and so as to reduce the chromic acid by the organic acid and thereby to prepare an aqueous solution not containing the hexavalent chromium ions;

(B) adding a pH adjustor to the aqueous solution not containing the hexavalent chromium ions so as to adjust pH to 1 to 4; and (C) further adding chromic acid to the aqueous solution not containing the hexavalent chromium ions which is obtained upon the pH adjustment, so as to prepare an aqueous solution containing the trivalent chromium ions and the hexavalent chromium ions.

First, in the step (A), chromic acid ($CrO_3$) and an organic acid are mixed with each other in an aqueous solution containing them. Upon mixing of both the acids, hexavalent chromium ions ($CrO_4^{2-}$) produced by dissolution of chromic acid are reduced by the organic acid to trivalent chromium ions ($Cr^{3+}$). The organic acid must be capable of reducing chromic acid. Examples of the organic acid which can be favorably used include oxalic acid, malonic acid, formic acid, glycine, succinic acid, lactic acid, etc.

The mixing is performed until a condition where the hexavalent chromium ions ($CrO_4^{2-}$) originating from the chromic acid ($CrO_3$) added to the aqueous solution are substantially not detected is reached. The mixing temperature, preferably, is 10 to 90° C., for example. While the temperature of the aqueous solution is normally raised by heat of dissolution and heat of reaction, the aqueous solution may be heated or cooled, as required. The mixing time, which varies depending on the temperature and agitation efficiency, may normally be 2 to 50 hours. Besides, upon completion of the step (A), the temperature of the aqueous solution obtained is preferably around room temperature (e.g., 10 to 30° C.).

In the step (A), the concentration of chromic acid in terms of the weight of chromium is preferably 60 to 140 g/L, particularly 80 to 120 g/L. On the other hand, the concentration of the organic acid is preferably 50 to 700 g/L, particularly 100 to 400 g/L. Besides, the ratio between chromic acid and the organic acid [(organic acid)/(chromic acid)] is preferably 1.5 to 4.0 (molar ratio), particularly 2.5 to 3.5 (molar ratio). Especially, the amount of the organic acid is preferably not less than the minimum amount required for reducing the whole of the chromic acid present in the aqueous solution (namely, not less than the equivalent), and is more preferably the equivalent. For example, in the case where the organic acid is oxalic acid dihydrate, the reaction formula is:

$$6((COOH)_2.2H_2O)+2CrO_3 \rightarrow Cr_2(C_2O_4)_3+6CO_2+18H_2O$$

and, in this case, the equivalent is (oxalic acid)/(chromic acid)=3 (molar ratio).

Incidentally, the hexavalent chromium ions in the chromium plating bath and in the aqueous solution as an intermediate product thereof can be analyzed and determined by the starch-iodine reaction in which an iodide is added to the bath or solution so as to oxidize the iodide to iodine by the hexavalent chromium ions present in the bath or solution, and the thus formed iodine is quantitatively determined by use of a thiosulfate solution. Besides, the trivalent chromium ions can be analyzed and determined by determining the whole amount of chromium by an atomic absorption method or the like and then subtracting the amount of the hexavalent chromium ions from the whole amount of chromium.

Next, in the step (B), a pH adjustor is added to the aqueous solution not containing hexavalent chromium ions which has been obtained in the step (A), so as to adjust pH to a value of 1 to 4, preferably 1.8 to 3.2. As the pH adjustor, there can be used aqueous ammonia, alkali hydroxides (NaOH, KOH, etc.) and the like. The addition of the pH adjustor is preferably conducted immediately upon the reduction of the chromic acid added in the step (A). In the case where the step (D) to be described later is carried out between the step (A) and the step (B), it is preferable to carry out the step (D) immediately after the step (A) and to carry out the step (B) immediately after the step (D).

Subsequently, in the step (C), chromic acid ($CrO_3$) is added to the aqueous solution not containing hexavalent chromium ions which is obtained upon the pH adjustment in the step (B), so as to prepare an aqueous solution containing trivalent chromium ions and hexavalent chromium ions. The amount of the chromic acid added in this step is set smaller than the amount of the chromic acid added in the step (A). In this instance, the concentration of the chromic acid in terms of the weight of chromium is preferably 0.1 to 40 g/L, particularly 5 to 35 g/L. At the time of adding chromic acid in the step (C), the organic acid capable of reducing the chromic acid added in the step (C) may remain in the aqueous solution not containing hexavalent chromium ions which is obtained on the step (A), in the case where the amount of the organic acid in terms of the ratio of the organic acid to the chromic acid is slightly larger than the equivalent necessary for reduction of the chromic acid. However, the amount (concentration) of the chromic acid added in the step (C) is smaller (lower) than the amount (concentration) of the chromic acid added in the step (A), and the amount (concentration) of the organic acid remaining in the system is small (low). Besides, pH has been adjusted, so that a reduction reaction hardly proceeds. Therefore, generation of heat is little, and the reduction reaction at this stage is slight. Consequently, most (substantially the whole) of the chromic acid added in the step (C) can be made to act as hexavalent chromium ions ($CrO_4^{2-}$).

The temperature at the time of the mixing, preferably, is in the range of 10 to 90° C., for example. Heating or cooling may be performed, if necessary. The mixing time, which varies depending on the temperature and agitation efficiency, may normally be 2 to 50 hours. Besides, it is preferable that, upon completion of the step (C), the temperature of the aqueous solution obtained is around room temperature (e.g., 10 to 30° C.).

Furthermore, in the method of preparing a chromium plating bath as above, the step of:

(D) adding one or more selected from the group consisting of a conducting salt, a stabilizer and an anti-pitting agent to the aqueous solution, may further be carried out in one or more selected from the group consisting of a period between the step (A) and the step (B), a period between the step (B) and the step (C), and a period after the step (C).

As the conducting salt, preferred are sulfates such as ammonium sulfate, sodium sulfate and potassium sulfate. The concentration of the sulfate as the conducting salt in terms of the weight of sulfate ions in the chromium plating bath is preferably 20 to 200 g/L, particularly 30 to 150 g/L.

Besides, as the stabilizer, preferable are boric acid, citric acid, methanesulfonic acid and the like. The concentration of the stabilizer in the chromium plating bath is preferably 5 to 60 g/L, particularly 10 to 40 g/L.

Further, as the anti-pitting agent, there can be preferably used anionic, cationic, nonionic, amphoteric and other surface active agents. In short, a known anti-pitting agent can be added in a publicly known concentration which is normally applicable. Among the surface active agents for use as the anti-pitting agent, the anionic surface active agents are preferred. Examples of a commercially available anti-pitting chemical containing a surface active agent include ASAHI BASE D-2 (anti-pitting agent for nickel electroplating) produced by C. Uyemura & Co., Ltd.

The chromium plating bath containing both trivalent chromium ions and hexavalent chromium ions as above is preferable for use in the case of forming a chromium plating film by electroplating, specifically in forming a plating film composed of a single layer or a plurality of layers on a substrate, as the whole part of the single layer constituting the plating film or as part or the whole part of the plurality of layers constituting the plating film.

In the chromium plating, conventionally known equipment for chromium plating can be used. As an anode for plating, those which have been known can be preferably used, for example, Pb-5% Sn, carbon, and platinum-on-titanium plating anodes. Agitation and filtration of the plating solution can also be carried out, as required. Especially, it is desirable to perform solution filtration functioning also as gentle agitation of the plating solution for the purpose of preventing the solution temperature from being scattered.

The plating temperature is preferably 30 to 70° C., particularly 40 to 60° C. The cathode current density is preferably 1 to 60 A/dm$^2$, particularly 5 to 30 A/dm$^2$. The plating method may be rack plating or the like, and may also be barrel plating or the like involving current interruptions. The plating time can be varied according to the thickness of the plating film demanded, and a thicker plating film can be obtained by prolonging the plating time. The plating time and the plating film thickness vary depending on the intended use of the article to be plated; usually, however, the plating time is 2 to 180 minutes, and the thickness of the plating film is 0.1 to 15 μm.

Besides, it is preferable to add a slurry (aqueous slurry) containing chromium hydroxide or basic chromium carbonate to the chromium plating bath decreased in the amount of trivalent chromium ions through formation of the chromium plating film by this method, so as to replenish the trivalent chromium ions, and to adjust pH. Particularly, when the trivalent chromium ions the amount of which has decreased are replenished by addition of chromium hydroxide, the matter added together with the trivalent chromium ions is only hydroxide ions. Therefore, when chromium hydroxide is added so as to replenish the trivalent chromium ions and to adjust pH, the hydroxide ions are neutralized to form water, so that addition of an unnecessary component(s) is avoided and an increase in the amount of a necessary component is obviated. When a chromium plating bath with the trivalent chromium ions replenished by use of chromium hydroxide or basic chromium carbonate in this manner is used, formation of a chromium plating film can be stably repeated without causing variation in the properties of the chromium plating film. Besides, the hexavalent chromium ions may be replenished by appropriately adding chromic acid in a required amount. Further, the other components, for example, the conducting salt, the stabilizer and the anti-pitting agent, may also be replenished by appropriately adding them in required amounts, respectively.

The formation of the chromium plating film by use of the chromium plating bath containing both trivalent chromium ions and hexavalent chromium ions as above is favorably applicable to the following cases.

(1) The above-mentioned formation of the chromium plating film is favorably applicable to the case where a plating film is composed of a plurality of layers, a step of forming a chromium plating film by chromium electroplating using a chromium plating bath containing both trivalent chromium ions and hexavalent chromium ions is conducted as a step of forming part of the plurality of layers, and a step of forming a nickel plating film is conducted as a step of forming part of the plurality of layers. Especially, the formation of the chromium plating film as above-mentioned is preferable for the case where a nickel plating film is formed on a substrate and a chromium plating film is formed on the nickel plating film by electroplating using a chromium plating bath containing both trivalent chromium ions and hexavalent chromium ions. Such a plating film is useful as a corrosion-preventive plating film for automotive exterior trim members or anti-salt-damage members. In this case, the thickness of the chromium plating film is normally 0.1 to 15 μm.

In the field of metal plating which is formed on a plastic or metallic blank such as an ABS blank and which is required to have corrosion resistance, complicated multi-layer plating steps are performed. In general, a microporous (MP) nickel plating for dispersing corrosion and enhancing corrosion resistance is applied, and chromium plating is applied onto the MP nickel plating film. Particularly, plated automotive exterior trims are required to have corrosion resistance (anti-salt-damage property) against an antifreezing agent such as calcium chloride scattered onto the exterior trims for prevention of freezing (icing) in a cold district.

In the plating on automotive exterior trims, trilayer nickel plating is adopted for enhancing corrosion resistance, wherein MP nickel plating is applied as the outermost layer of the trilayer nickel plating, and chromium plating is applied as a further outer layer thereon. A chromium plating film formed from a conventional chromium plating bath containing hexavalent chromium ions mainly and containing a small amount of trivalent chromium ions, as chromium ions, has cracks, which are a kind of defect in plating. In order to disperse corrosion and thereby to obviate this problem, the MP nickel plating is needed.

Besides, a chromium plating film formed from a conventional chromium plating bath containing trivalent chromium ions but not containing hexavalent chromium ions does not show generation of cracks due to eutectoid with carbon. However, such a chromium plating film is not accompanied by an oxide film (chromate film) which is usually formed on the surface of a chromium plating film formed from a chromium plating bath containing hexavalent chromium ions mainly and containing a small amount of trivalent chromium ions, as chromium ions. Therefore, the chromium plating film formed from the chromium plating bath containing trivalent chromium ions but not containing hexavalent chromium ions is lower in corrosion resistance than the chromium plating film formed from the chromium plating bath containing hexavalent chromium ions mainly and containing a small amount of trivalent chromium ions, as chromium ions.

In contrast to the above, the chromium plating film formed from the chromium plating bath containing both trivalent chromium ions and hexavalent chromium ions can have sufficient corrosion resistance even without the MP nickel plating, because of the synergistic effect of the formation of an oxide film on the surface of the chromium plating film and the crack-free state of the plating film. As a result, the plating process can be simplified, and economy is enhanced.

In addition, the above-mentioned formation of the chromium plating film is favorably applicable also to the case where, as a step of forming part of a plurality of layers over a substrate, a chromium plating film is formed by chromium electroplating using a chromium plating bath containing both trivalent chromium ions and hexavalent chromium ions, then a nickel plating film is formed on the chromium plating film, and further a chromium plating film is formed on the nickel plating film by chromium electroplating using a chromium plating bath containing both trivalent chromium ions and hexavalent chromium ions.

The case in which a plating film is composed of a plurality of layers, a step of forming a chromium plating film by chromium electroplating using a chromium plating bath containing both trivalent chromium ions and hexavalent chromium ions is conducted as a step of forming part of the plurality of layers and a step of forming a nickel plating film is conducted as a step of forming part of the plurality of layers, to thereby form a corrosion-resistant plating film, will now be considered more specifically. In such a case, a chromium plating film is formed as an undercoat, preferably in a thickness of 0.3 to 1 μm, by chromium electroplating using a chromium plating bath containing both trivalent chromium ions and hexavalent chromium ions. Then, in order to eliminate pinholes, a nickel plating film is formed on the chromium plating film in a larger thickness, for example, in a thickness of not less than 1 μm, particularly in a thickness of 3 to 20 μm. Further, a chromium plating film is formed on the nickel plating film by chromium electroplating using a chromium plating bath containing both trivalent chromium ions and hexavalent chromium ions, preferably in a thickness of 0.3 to 0.8 μm. By this procedure, corrosion resistance can be enhanced markedly.

To be more specific, a laminated (or multi-layer) plating film of Cr—Ni—Cr is adopted. In this case, first, the chromium plating film having good corrosion resistance is formed on a blank by use of the chromium plating bath containing both trivalent chromium ions and hexavalent chromium ions. Then, the nickel plating film is formed in a large thickness on the chromium plating film so as to eliminate such defects as pinholes in the plating. Further, the chromium plating film having good corrosion resistance is formed on the nickel plating film by use of the chromium plating bath containing both trivalent chromium ions and hexavalent chromium ions. This ensures that the corrosion resistance of the plating film is offered mainly by the chromium plating films, and the prevention of generation (or presence) of pinholes is effected mainly by the nickel plating film, whereby a remarkably enhanced corrosion resistance is obtained.

(2) The above-mentioned formation of the chromium plating film is favorably applicable to the case where a plating film is composed of a plurality of layers, a step of forming a chromium plating film by chromium electroplating using a chromium plating bath containing both trivalent chromium ions and hexavalent chromium ions is conducted as a step of forming part of the plurality of layers, and a step of forming a noble metal plating film is conducted as a step of forming part of the plurality of layers, but a step of forming a nickel plating film is not conducted as a step of forming part of the multiple layers. Particularly, the above-mentioned formation of the chromium plating film is favorably applicable to the case where a chromium plating film is formed on a substrate by electroplating using a chromium plating bath containing both trivalent chromium ions and hexavalent chromium ions, and a noble metal plating film composed of one selected from the group consisting of gold, platinum, silver, rhodium and their alloys is formed on the chromium plating film. Such a plating film is useful as a corrosion-preventive plating film for members (articles) to be put in constant contact with a human body, such as temples of pairs of glasses, buttons, finger rings, earrings, and pierced earrings. In this case, the thickness of the chromium plating film is normally 0.3 to 0.8 μm.

In decorative parts, particularly those put in contact with a human body, a noble metal plating is applied for such purposes as enhancing lustrous appearance and corrosion resistance, and, normally, nickel plating is applied to the substrate as an undercoat for the noble metal plating. However, the nickel plating is susceptible to corrosion, and, upon leakage of nickel ions due to corrosion, a rash on a human body skin may occur when the human body has a nickel allergy problem.

If a chromium plating film is formed by use of a chromium plating bath containing body trivalent chromium ions and hexavalent chromium ions and a noble metal plating is applied onto the chromium plating film without performing the above-mentioned nickel plating, the absence of cracks in the chromium plating film ensures a high corrosion resistance and prevention of elution of the blank material. In addition, since the nickel plating film is not formed, the nickel allergy problem which might arise from the nickel plating film can be obviated. Besides, plating stress is slight and the hardness of the plating is not lowered by heating, so that the plating film obtained is also excellent in heat resistance. Furthermore, it is also a great advantage that the noble metal plating can be applied directly on the chromium plating film.

(3) The above-mentioned formation of the chromium plating film is favorably applicable to the case where a plating film is composed of a plurality of layers, a step of forming a chromium plating film by chromium electroplating using a first chromium plating bath containing both trivalent chromium ions and hexavalent chromium ions is conducted as a step of forming part of the plurality of layers, and a step of forming a second chromium plating film by use of a second chromium plating bath different from the first chromium plating bath is conducted as a step of forming part of the plurality of layers.

Particularly, the above-mentioned formation of the chromium plating film is favorably applicable to:

the case where a first chromium plating film is formed on a substrate, preferably in a thickness of 0.3 to 0.8 μm, by electroplating using the first chromium plating bath and a second chromium plating film is formed on the first chromium plating film, preferably in a thickness of 1 to 200 μm, by use of a second chromium plating bath different from the first chromium plating bath; or the case where a second chromium plating film is formed on a substrate, preferably in a thickness of 1 to 100 μm, by use of a second chromium plating bath different from the first chromium plating bath and a first chromium plating film is formed on the second chromium plating film, preferably in a thickness of 0.3 to 5 μm, by electroplating using the first chromium plating bath.

The second chromium plating bath, preferably, is a hard chromium plating bath which contains hexavalent chromium ions mainly and contains a small amount of trivalent chromium ions, as chromium ions. In this case, the proportion of the amount of the hexavalent chromium ions based on the total amount of the chromium ions is preferably 90 to 99%, particularly, 93 to 98%, while the proportion of the amount of the trivalent chromium ions is preferably 1 to 10%, particularly 2 to 7%. Furthermore, the second chromium plating bath may contain known additives for chromium plating baths.

Especially, by a procedure in which a first chromium plating film is formed as an undercoat for a hard chromium plating by use of the first chromium plating bath and a hard chromium plating film is formed on the thus formed crack-free chromium plating film by use of the second chromium plating bath, a good hard chromium plating film having excellent corrosion resistance can be formed.

In addition, the above-mentioned steps may be reversed, that is, the first chromium plating film may be formed by use of the first chromium plating bath on the second chromium plating film formed by use of the second chromium plating bath. In this case, a hard chromium plating film having more excellent corrosion resistance can be formed, since the chromium plating film formed by use of the chromium plating bath containing both trivalent chromium ions and hexavalent chromium ions has a higher hardness. Furthermore, depending on the intended use of the product, or in the case where the chromium plating film may be comparatively thin (for example, about 1 to 5 μm), the whole part of the chromium plating film may be formed by use of the first chromium plating bath so as to form a chromium plating film which is hard and is excellent in corrosion resistance.

(4) The above-mentioned formation of the chromium plating film is favorably applicable to the case where a chromium plating film is formed by chromium electroplating based on barrel plating. In the case where barrel plating is carried out by use of a chromium plating bath containing hexavalent chromium ions mainly and containing a small amount of trivalent chromium ions, as chromium ions, an interruption or interruptions of the current during plating would cause generation of defective appearance (stains or the like) of plating. Therefore, it has been impossible to use such a chromium plating bath in barrel plating which involves current interruptions. On the other hand, in the case where barrel plating is carried out using a chromium plating bath containing both trivalent chromium ions and hexavalent chromium ions, defects of plating such as defective appearance would not be generated notwithstanding the plating method which involves current interruptions, such as barrel plating. Therefore, the use of the chromium plating bath containing both trivalent chromium ions and hexavalent chromium ions makes it possible to form a chromium plating film with good appearance by barrel plating. Incidentally, in this case, the thickness of the chromium plating film is normally 0.01 to 0.5 μm.

EXAMPLES

Now, the present invention will be described more in detail below by showing Examples, Comparative Examples and Experimental Examples, but the invention is not to be limited by the following Examples.

Preparation Example 1

Chromic acid anhydride and oxalic acid were mixed into and dissolved in water to prepare 5 L of an aqueous solution containing 150 g/L of chromic acid anhydride ($CrO_3$) and 567 g/L of oxalic acid dihydrate. In this instance, heat generation occurred to raise the solution temperature to 85° C., and the solution was cooled by only standing to cool. The aqueous solution was stirred for 3 hours, to complete dissolution and reaction of chromic acid anhydride and oxalic acid. At this stage, the temperature of the aqueous solution had become room temperature. When the concentration of hexavalent chromium ions (chromic acid) in the aqueous solution after the dissolution and reaction was measured by the starch-iodine reaction, no hexavalent chromium ion was detected. On the other hand, the concentration of trivalent chromium ions ($Cr^{3+}$) in the aqueous solution after the reaction was measured by an atomic absorption photometry, to be 78 g/L in terms of the weight of chromium, the value corresponding to the amount of chromium in the chromic acid anhydride mixed.

Next, 80 g/L of ammonium sulfate was mixed into the aqueous solution with agitation, and, further, pH was adjusted to 2.2 by use of aqueous ammonia.

Subsequently, chromic acid anhydride ($CrO_3$) was added to and dissolved in the aqueous solution in such an amount as to correspond to 20 g/L. In this instance, heat generation occurred to raise the solution temperature to 30° C. The aqueous solution was agitated for 1 hour, to complete the dissolution. The concentration of hexavalent chromium ions (chromic acid) in the aqueous solution after the dissolution and reaction was measured by the above-mentioned method, to be 10 g/L in terms of the weight of chromium. This quantity was slightly smaller than, but was substantially corresponding to, the amount of chromium in the chromic acid anhydride added at the time of the second addition. On the other hand, the concentration of trivalent chromium ions ($Cr^{3+}$) in the aqueous solution after the reaction was measured by the above-mentioned method, to be 78.4 g/L in terms of the weight of chromium. This quantity was slightly larger than, but was substantially corresponding to, the quantity measured at the time of the first measurement, and was corresponding substantially to the amount of chromium in the chromic acid anhydride added at the time of the first addition.

Preparation Comparative Example 1

Chromic acid anhydride and oxalic acid were mixed into and dissolved in water to prepare 5 L of an aqueous solution containing 170 g/L of chromic acid anhydride ($CrO_3$) and 605 g/L of oxalic acid dihydrate. In this instance, heat generation occurred to raise the solution temperature to 88° C., and the solution was cooled by only standing to cool. The aqueous solution was agitated for 3 hours, to complete dissolution and reaction of chromic acid anhydride and oxalic acid. At this stage, the temperature of the aqueous solution had become room temperature. The concentration of hexavalent chromium ions (chromic acid) in the aqueous solution after the dissolution and reaction was measured by the starch-iodine reaction, to be 5 g/L in terms of the weight of chromium. On the other hand, the concentration of trivalent chromium ions ($Cr^{3+}$) in the aqueous solution after the reaction was measured by an atomic absorption photometry, to be 83.2 g/L in terms of the weight of chromium.

Next, 80 g/L of ammonium sulfate was mixed into the aqueous solution with agitation.

Subsequently, pH was adjusted to 2.2 by use of aqueous ammonia, to obtain a chromium plating bath. When the concentration of hexavalent chromium ions (chromic acid) and the concentration of trivalent chromium ions ($Cr^{3+}$) in the chromium plating bath thus obtained were measured by the above-mentioned method, the concentrations were found to be not varied from the values measured at the time of the first measurement.

Preparation Comparative Example 2

Chromic acid anhydride and oxalic acid were mixed into and dissolved in water to prepare 5 L of an aqueous solution containing 170 g/L of chromic acid anhydride ($CrO_3$) and 529 g/L of oxalic acid dihydrate. In this instance, heat generation occurred but the temperature rise was suppressed to a level of 35° C. by cooling the system by a freezer. The aqueous solution was agitated for 4 hours, to complete dissolution and reaction of chromic acid anhydride and oxalic acid. At this stage, the temperature of the aqueous solution had become room temperature. The concentration of hexavalent chromium ions (chromic acid) in the aqueous solution after the dissolution and reaction was measured by the starch-iodine reaction, to be 15 g/L in terms of the weight of chromium. On the other hand, the concentration of trivalent chromium ions ($Cr^{3+}$) in the aqueous solution after the reaction was measured by an atomic absorption photometry, to be 72.8 g/L in terms of the weight of chromium.

Next, 80 g/L of ammonium sulfate was mixed into the aqueous solution with stirring.

Subsequently, pH was adjusted to 2.2 by use of aqueous ammonia, to obtain a chromium plating bath. When the concentration of hexavalent chromium ions (chromic acid) and the concentration of trivalent chromium ions ($Cr^{3+}$) in the chromium plating bath thus obtained were measured by the above-mentioned method, the concentrations were found to be not varied from the values measured at the time of the first measurement.

From the above results it is seen that in Preparation Example 1, the amounts of chromic acid to be added can be controlled according to the desired quantities of trivalent chromium ions and hexavalent chromium ions, by ensuring that the chromic acid added at the time of the first addition supplies the trivalent chromium ions in the chromium plating bath finally obtained and that the chromic acid added at the time of the second addition supplies the hexavalent chromium ions in the chromium plating bath finally obtained.

On the other hand, in Preparation Comparative Example 1, the amount of chromic acid added was the same as the total amount of chromic acid added by the first addition and the second addition in Preparation Example 1, but the added chromic acid were excessively reduced to trivalent chromium ions. Besides, in Preparation Comparative Example 2, also, the amount of chromic acid added was the same as the total amount of chromic acid added by the first addition and the second addition in Preparation Example 1, but reduction of chromic acid did not take place sufficiently and, therefore, the eventual content of trivalent chromium ions was smaller than that in Preparation Example 1. In either of these cases, for bringing the contents (content ratio) of trivalent chromium ions and hexavalent chromium ions to a desired ratio, it is necessary to select an optimum reaction temperature and an optimum reaction time by a try and error method and to rigorously control the reaction conditions, which involves intricate operations. In contrast, according to the chromium plating bath preparation method pertaining to the present invention, the contents (content ratio) of trivalent chromium ions and hexavalent chromium ions can be controlled to desired values (a desired value) easily and assuredly.

Example 1

A Pb-5% Sn anode was disposed in a polyvinyl chloride-coated plating tank, and 1,000 L of the chromium plating bath prepared in Preparation Example 1 was placed in the plating tank. A plated article as follows, having a plating area of 400 $dm^2$, was immersed in the plating bath, which was heated to 48° C., and chromium plating was conducted at a cathode current density of 10 $A/dm^2$ for 8.5 minutes, to form a chromium plating film in a thickness of 0.4 μm.

[Plated Article]

The plated article was obtained by using an ABS resin sheet as a substrate and subjecting the surface of the substrate sequentially to the following treatments.

Chromic acid etching [LACUSHU CNN, produced by C. Uyemura & Co., Ltd.]: 65° C., 10 minutes Electroless nickel plating [LACUSHU NFF, produced by C. Uyemura & Co., Ltd.]: 40° C., 8 minutes, film thickness 200 nm Copper electroplating from copper sulfate [LACUSHU EAB, produced by C. Uyemura & Co., Ltd.]: cathode current density 3 $A/dm^2$, 25° C., 25 minutes, film thickness 15 μm Semi-bright nickel plating [LACUSHU ASB, produced by C. Uyemura & Co., Ltd.]: cathode current density 4 $A/dm^2$, 53° C., 20 minutes, film thickness 15 μm Bright nickel plating [LACUSHU ANN, produced by C. Uyemura & Co., Ltd.]: cathode current density 4 $A/dm^2$, 53° C., 13 minutes, film thickness 10 μm Microporous nickel plating [LACUSHU AMC, produced by C. Uyemura & Co., Ltd.]: cathode current density 4 $A/dm^2$, 53° C., 3 minutes, film thickness 2 μm Example 2

A chromium plating film was formed on a plated article in the same manner as in Example 1, except that the plated article had been obtained without conducting the microporous nickel plating.

Comparative Example 1

A chromium plating film was formed on a plated article in the same manner as in Example 1, except that a chromium plating bath containing hexavalent chromium ions mainly and containing a small amount of trivalent chromium ions, as chromium ions, was used and the chromium plating was carried out in the following conditions.

Chromium plating [ASAHI CHROME NC, produced by C. Uyemura & Co., Ltd.]: cathode current density 10 $A/dm^2$, 45° C., 8.5 minutes, film thickness 0.4 μm Comparative Example 2

A chromium plating film was formed on a plated article in the same manner as in Comparative Example 1, except that the plated article had been obtained without performing the microporous nickel plating.

Example 3

A chromium plating film was formed on a plated article in the same manner as in Example 1, except that the following plated article was used in place of the plated article used in Example 1.

[Plated Article]

The plated article was obtained by using a mild steel sheet as a substrate and subjecting the surface of the substrate sequentially to the following treatments.

Semi-bright nickel plating [LACUSHU ASB, produced by C. Uyemura & Co., Ltd.]: cathode current density 4 A/dm$^2$, 53° C., 20 minutes, film thickness 15 μm Bright nickel plating [LACUSHU ANN, produced by C. Uyemura & Co., Ltd.]: cathode current density 4 A/dm$^2$, 53° C., 13 minutes, film thickness 10 μm Microporous nickel plating [LACUSHU AMC, produced by C. Uyemura & Co., Ltd.]: cathode current density 4 A/dm$^2$, 53° C., 3 minutes, film thickness 2 μm Example 4

A chromium plating film was formed on a plated article in the same manner as in Example 3, except that the plated article had been obtained without conducting the microporous nickel plating.

Comparative Example 3

A chromium plating film was formed on a plated article in the same manner as in Example 3, except that a chromium plating bath containing hexavalent chromium ions mainly and containing a small amount of trivalent chromium ions, as chromium ions, was used and the chromium plating was carried out in the following conditions.

Chromium plating [ASAHI CHROME NC, produced by C. Uyemura & Co., Ltd.]: cathode current density 10 A/dm$^2$, 45° C., 8.5 minutes, film thickness 0.4 μm Comparative Example 4

A chromium plating film was formed on a plated article in the same manner as in Comparative Example 3, except that the plated article had been obtained without performing the microporous nickel plating.

Corrosion Resistance Test 1

The plating films formed in Examples 1 to 4 and Comparative Examples 1 to 4 were served to a CASS test according to JIS H 8502. In Comparative Examples 1 and 3 in which the chromium plating film was formed on a plated article (having undergone microporous nickel plating) by use of the chromium plating bath containing hexavalent chromium ions mainly and containing a small amount of trivalent chromium ions, as chromium ions, a conspicuous number of corrosions of nickel plating were detected as pits after six cycles of the CASS test. Besides, in Comparative Examples 2 and 4 in which the chromium plating film was formed on a plated article (having been obtained without microporous nickel plating) by use of the chromium plating bath containing hexavalent chromium ions mainly and containing a small amount of trivalent chromium ions, as chromium ions, heavy corrosions, though not so many as those in Comparative Examples 1 and 3, were detected after six cycles of the CASS test.

On the other hand, in Examples 1 to 4 in which the chromium plating film was formed by use of the chromium plating bath containing both trivalent chromium ions and hexavalent chromium ions, corrosion was not detected after six cycles of the CASS test, irrespectively of the presence or absence of the microporous nickel plating. Thus, in the cases where the chromium plating film is formed by use of the chromium plating bath containing both trivalent chromium ions and hexavalent chromium ions, high corrosion resistance of the plating films can be obtained. Furthermore, the high corrosion resistance can be obtained even in the absence of the microporous nickel plating. Accordingly, the microporous nickel plating step can be omitted.

Corrosion Resistance Test 2

The plating films formed in Examples 1 to 4 and Comparative Examples 1 to 4 were served to a test in which the plating film is coated with a mixture of calcium chloride and kaolin (a mixture of 3 g of kaolin with 5 mL of a saturated aqueous solution of calcium chloride) and is left to stand for 1 week. In Comparative Examples 1 to 4 in which the chromium plating film was formed by use of the chromium plating bath containing hexavalent chromium ions mainly and containing a small amount of trivalent chromium ions, as chromium ions, quite large conspicuous corrosions were locally observed and, in some specimens, the resin or steel sheet as the substrate was exposed, irrespectively of the presence or absence of the microporous nickel plating.

On the other hand, in Examples 1 to 4 in which the chromium plating film was formed by use of the chromium plating bath containing both trivalent chromium ions and hexavalent chromium ions, corrosion was not detected, irrespectively of the presence or absence of the microporous nickel plating. In the case where a chromium plating film is formed by use of a chromium plating bath containing both trivalent chromium ions and hexavalent chromium ions, the chromium plating film, formed for example on an anti-salt-damage member for use in environments in which a snow-melting salt is used, can exhibit high corrosion resistance.

Preparation Example 2

A chromium plating bath was obtained in the same manner as in Preparation Example 1, except that 150 g/L of sodium sulfate and 10 g/L of boric acid were used in place of 80 g/L of ammonium sulfate.

Example 5

A Pb-5% Sn anode was disposed in a polyvinyl chloride-coated plating tank, and 1,000 L of the chromium plating bath prepared in Preparation Example 2 was placed in the plating tank. An ornamental copper metal blank having a plating area of 400 dm$^2$ as a plated article (substrate) to be plated was immersed in the plating bath, which was heated to 48° C., and chromium plating was conducted at a cathode current density of 10 A/dm$^2$ for 20 minutes, to form a chromium plating film in a thickness of 1 μm.

Next, the thus formed plating film was subjected to the following treatment, to obtain a plating film.

Au electroplating [AURUNA 535, produced by C. Uyemura & Co., Ltd.]: cathode current density 0.5 A/dm$^2$, 25° C., 5 minutes, film thickness 1 μm Comparative Example 5

A plating film was formed in the same manner as in Example 5, except that a chromium plating bath containing hexavalent chromium ions mainly and containing a small amount of trivalent chromium ions, as chromium ions, was used and the plating was conducted in the following conditions.

Chromium plating [ASAHI CHROME NC, produced by C. Uyemura & Co., Ltd.]: cathode current density 10 A/dm$^2$, 45° C., 8.5 minutes, film thickness 0.4 μm Comparative Example 6

A plating film was formed in the same manner as in Example 5, except that the following treatment was conducted before the formation of the chromium plating film.

Nickel plating [NISTAR 823, produced by C. Uyemura & Co., Ltd.]: cathode current density 4 A/dm$^2$, 55° C., 1.5 minutes, film thickness 1 μm Comparative Example 7

A plating film was formed in the same manner as in Example 5, except that the following treatment was conducted after the formation of the chromium plating film and before Au electroplating.

Nickel plating [NISTAR 823, produced by C. Uyemura & Co., Ltd.]: cathode current density 4 A/dm$^2$, 55° C., 1.5 minutes, film thickness 1 μm Comparative Example 8

A plating film was formed in the same manner as in Example 5, except that the following nickel plating was performed in place of the chromium plating.

Nickel plating [NISTAR 823, produced by C. Uyemura & Co., Ltd.]: cathode current density 4 A/dm$^2$, 55° C., 1.5 minutes, film thickness 1 μm Corrosion Resistance Test 3

The plating films formed in Example 5 and Comparative Examples 5 to 8 were served to a CASS test according to JIS H 8502. In Comparative Example 5 in which the chromium plating film was formed by use of the chromium plating bath containing hexavalent chromium ions mainly and containing a small amount of trivalent chromium ions, as chromium ions, corrosion of the blank was detected upon five cycles of the CASS test. Besides, in Comparative Examples 6 to 8 in which the nickel plate film was formed, a trace amount of a nickel compound was observed on the surface of the gold plating after five cycles of the CASS test.

On the other hand, in Example 5 in which the chromium plating film was formed by use of the chromium plating bath containing both trivalent chromium ions and hexavalent chromium ions, corrosion was not detected after five cycles of the CASS test.

Furthermore, the plated articles with the plating film formed thereon were subjected to a heating treatment at 500° C. for 5 minutes. In Comparative Examples 6 to 8 in which the nickel plating film was formed, discoloration of the Au plating was observed. This is considered to be the result of a process in which the undercoat nickel diffuses to the upper surface of the gold plating and is oxidized, resulting in discoloration. On the other hand, discoloration was not observed in Example 5.

From the above results, it is seen that the nickel plating film as the undercoat for a noble metal plating is susceptible to corrosion. Further, it is seen that the conventional hexavalent chromium plating would lead to easy corrosion of the blank, but, in the present invention, corrosion of the blank is drastically suppressed and the gold-plated article exhibits good corrosion resistance, even in the absence of a nickel plating film which would cause nickel allergy.

Example 6

A Pb-5% Sn anode was disposed in a polyvinyl chloride-coated plating tank, and 1,000 L of the chromium plating bath prepared in Preparation Example 1 was placed in the plating tank. A steel sheet having a plating area of 400 dm$^2$ as a plated article (substrate) to be plated was immersed in the chromium plating bath, which was heated to 48° C., and chromium plating was conducted at a cathode current density of 10 A/dm$^2$ for 8.5 minutes, to form a chromium plating film in a thickness of 0.4 μm.

Next, the thus formed chromium plating film was subjected to the following treatment, to form a plating film thereon.

Hard chromium plating (a plating bath containing hexavalent chromium ions mainly and containing a small amount of trivalent chromium ions, as chromium ions) [U-PRO CHROME CHC, produced by C. Uyemura & Co., Ltd.]: cathode current density 40 A/dm$^2$, 60° C., 120 minutes, film thickness 50 μm Example 7

A plating film was formed in the same manner as in Example 6, except that the sequence of execution of the chromium plating by use of the chromium plating bath prepared in Preparation Example 1 and the chromium plating by use of a hard chromium plating bath containing hexavalent chromium ions mainly and containing a small amount of trivalent chromium ions, as chromium ions, was reversed.

Comparative Example 9

A plating film was formed in the same manner as in Example 6, except that the chromium plating by use of the chromium plating bath prepared in Preparation Example 1 and the hard chromium plating were not applied to the plated article and that the following treatment was applied to the plated article.

Hard chromium plating (a plating bath containing hexavalent chromium ions mainly and containing a small amount of trivalent chromium ions, as chromium ions) [U-PRO CHROME CHC, produced by C. Uyemura & Co., Ltd.]: cathode current density 40 A/dm$^2$, 60° C., 120 minutes, film thickness 50 μm Comparative Example 10

A plating film was formed in the same manner as in Example 6, except that the chromium plating by use of the chromium plating bath prepared in Preparation Example 1 was not applied to the plated article and that the following treatments were applied to the plated article.

Semi-bright nickel plating [LACUSHU ASB, produced by C. Uyemura & Co., Ltd.]: cathode current density 4 A/dm$^2$, 53° C., 20 minutes, film thickness 15 μm Bright nickel plating [LACUSHU ANN, produced by C. Uyemura & Co., Ltd.]: cathode current density 4 A/de, 53° C., 13 minutes, film thickness 10 μm Hard chromium plating (a plating bath containing hexavalent chromium ions mainly and containing a small amount of trivalent chromium ions, as chromium ions) [U-PRO CHROME CHC, produced by C. Uyemura & Co., Ltd.]: cathode current density 40 A/dm$^2$, 60° C., 120 minutes, film thickness 50 μm Corrosion Resistance Test 4

The plating films formed in Examples 6 and 7 and Comparative Examples 9 and 10 were served to a CASS test according to JIS H 8502. In Comparative Examples 9 and 10 in which the chromium plating film was formed by use of the hard chromium plating bath containing hexavalent chromium ions mainly and containing a small amount of trivalent chromium ions, as chromium ions, the rating number upon five cycles of the CASS test was not more than 9.0, irrespectively of the presence or absence of the nickel plating film.

On the other hand, in Examples 6 and 7 in which the chromium plating film was formed by use of the chromium plating bath containing both trivalent chromium ions and hexavalent chromium ions, the rating number upon five cycles of the CASS test was 9.8 in Example 6 and 9.9 in Example 7. These results show that corrosion resistance is enhanced according to the present invention.

Example 8

A Pb-5% Sn anode was disposed in a polyvinyl chloride-coated plating tank, and 1,000 L of the chromium plating bath prepared in Preparation Example 1 was placed in the plating tank. A steel sheet having a plating area of 400 $dm^2$ as a plated article (substrate) to be plated was immersed in the plating bath, which was heated to 48° C., and chromium plating was conducted at a cathode current density of 10 $A/dm^2$ for 8.5 minutes, to form a chromium plating film in a thickness of 0.4 μm.

Next, the thus formed chromium plating film was subjected to the following treatments, to form a plating film.

Semi-bright nickel plating [LACUSHU ASB, produced by C. Uyemura & Co., Ltd.]: cathode current density 4 $A/dm^2$, 53° C., 20 minutes, film thickness 15 μm Bright nickel plating [LACUSHU ANN, produced by C. Uyemura & Co., Ltd.]: cathode current density 4 $A/dm^2$, 53° C., 13 minutes, film thickness 10 μm Furthermore, a chromium plating film was formed, under the same conditions as above, by use of the chromium plating bath prepared in Preparation Example 1.

Comparative Example 11

A chromium plating film was formed in the same manner as in Example 8, except that a chromium plating bath containing hexavalent chromium ions mainly and containing a small amount of trivalent chromium ions, as chromium ions, was used as a chromium plating bath in place of the chromium plating bath prepared in Preparation Example 1 and the plating was carried out in the following conditions.

Chromium plating [ASAHI CHROME NC, produced by C. Uyemura & Co., Ltd.]: cathode current density 10 $A/dm^2$, 45° C., 8 minutes, film thickness 0.4 μm Corrosion Resistance Test 5

The plating films formed in Example 8 and Comparative Example 11 were served to a CASS test according, to JIS H 8502. In Comparative Example 11 in which the chromium plating film was formed by use of the chromium plating bath containing hexavalent chromium ions mainly and containing a small amount of trivalent chromium ions, as chromium ions, the rating number upon three cycles of the CASS test was not more than 9.0.

On the other hand, in Example 8 in which the chromium plating film was formed by use of the chromium plating bath containing both trivalent chromium ions and hexavalent chromium ions, the rating number upon three cycles of the CASS test was 10. These results show that the present invention promises excellent corrosion resistance.

Example 9

While using the chromium plating bath prepared in Preparation Example 2, metallic blanks (nickel-plated bolts) were placed in a barrel plating apparatus, and barrel plating was conducted at an average current density of 4 $A/dm^2$ and a temperature of 48° C. for 60 minutes, to form a chromium plating film on each of the metallic blanks.

Comparative Example 12

A chromium plating film was formed in the same manner as in Example 9, except that a chromium plating bath containing hexavalent chromium ions mainly and containing a small amount of trivalent chromium ions, as chromium ions, was used as the chromium plating bath.

Chromium plating [ASAHI CHROME NC, produced by C. Uyemura & Co., Ltd.]

The chromium plating film obtained in Example 9 had a good appearance. On the other hand, in the case of the chromium plating film obtained in Comparative Example 12, white stains as well as white tarnish (dull) and burns were observed on the chromium plating film. It is seen from these results that a plating film with good appearance can be formed through barrel plating according to the present invention.

Experimental Example 1

While using 5 L of a plating solution prepared in the same manner as in Preparation Example 1, a 2-$dm^2$ metallic sheet was subjected to electrolysis at a current density of 10 $A/dm^2$ for 50 hours. As the plating solution, a chromium hydroxide slurry (containing 10% of chromium hydroxide) was used and its pH was adjusted to 2.2 at a time interval of 2 hours. According to a decrease in the concentration of trivalent chromium ions, the chromium hydroxide slurry was replenished so as to attain the initial concentration of trivalent chromium ions. During this period, 840 g of the slurry was needed. When the slurry was replenished in the just-mentioned manner, the solution composition at the initial make-up of the electrolytic solution was kept unchanged. In this case, the same appearance and physical properties of the plating film as those at the time of the initial make-up of the electrolytic solution can be obtained even after 50 hours of electrolysis. Furthermore, when the electrolysis was conducted continuously, the same conditions were maintained and the appearance and physical properties of the plating film were good, even after 500 hours of electrolysis.

Experimental Example 2

While using 5 L of a plating solution prepared in the same manner as in Preparation Example 1, a 2-$dm^2$ metallic sheet was subjected to electrolysis at a current density of 10 $A/dm^2$ for 50 hours. As the plating solution, aqueous ammonia was used. The concentration of trivalent chromium ions was adjusted by use of chromium sulfate. At a time interval of 2 hours, the pH of the solution was adjusted to 2.2 and replenishing of trivalent chromium ions was conducted. According to a decrease in the concentration of trivalent chromium ions, chromium sulfate was replenished so as to attain the initial concentration of trivalent chromium ions. During this period, 606 g of aqueous ammonia was needed; besides, 453 g of a 35% solution of chromium sulfate was needed. When such a control was carried out, the concentration of ammonium sulfate was increased, as checked after 50 hours of electrolysis, by 9.5% based on the concentration in the solution composition at the initial make-up of the electrolytic solution. In this case, white tarnish (dull) was generated locally on the appearance of the plating film after 50 hours. Furthermore, white tarnish and black portions were generated locally after 100 hours.

Japanese Patent Application No. 2008-294007 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method of preparing a chromium plating bath containing trivalent chromium ions and hexavalent chromium ions, comprising the steps of:

(A) mixing chromic acid and an organic acid in an aqueous solution containing these acids and reducing chromic acid by the organic acid so as to prepare an aqueous solution not containing hexavalent chromium ions;

(B) adding a pH adjustor to the aqueous solution not containing hexavalent chromium ions so as to adjust pH to a value of 1 to 4; and (C) farther adding chromic acid to the aqueous solution not containing hexavalent chromium ions and having undergone the pH adjustment so as to prepare an aqueous solution containing trivalent chromium ions and hexavalent chromium ions.

2. The method of preparing a chromium plating bath according, to claim 1, wherein in the step (A), chromic acid in an amount of 60 to 140 g/L in terms of the weight of chromium and 50 to 700 g/L of the organic acid are mixed with each other so that the ratio between the amounts of the acids is (organic acid)/(chromic acid)=1.5 to 4,0 (molar ratio).

3. The method of preparing a chromium plating bath according to claim 1, wherein chromic acid in an amount of 0.1 to 40 g/L in terms of the weight of chromium is added in the step (C).

4. The method of preparing a chromium plating bath according to claim 1, further comprising the step of:

(D)) adding one or more selected from the group consisting of a conducting salt, a stabilizer and an anti-pitting agent to the aqueous solution, in one or more selected from the group consisting of a period between the step (A) and the step (B), a period between the step (B) and the step (C), and a period after the step (C).

5. The method of preparing a chromium plating bath according to claim 1 further comprising the step of:

(D-1) adding, one or more sulfates as a conducting salt during one or more periods selected from the group consisting of a period between the step (A) and the step (B), a period between the step (B) and the step (C), and a period after the step (C), wherein the chromium plating bath is an electroplating chromium plating bath.

6. The method of preparing a chromium plating bath according to claim 5, further comprising the step of:

(D-2) adding one or more additives selected from the group consisting of a stabilizer and an anti-pitting agent, to the aqueous solution, during one or more periods selected from the group consisting of a period between the step (A) and the step (B), a period between the step (B) and the step (C), and a period after the step (C).

* * * * *